US005582196A

United States Patent [19]

Hae et al.

[11] Patent Number: 5,582,196

[45] Date of Patent: Dec. 10, 1996

[54] MULTIPURPOSE CANE

[76] Inventors: Shyu S. Hae, 9F, No. 15, Lane 51, Min Chuan St. Jwu Nan, Miaoli; William Du, No. 57-7, Alley 90, Sanguang Lane, Lin 22, Peishing Li, Peitun District, Taichung, both of Taiwan

[21] Appl. No.: 641,724

[22] Filed: May 2, 1996

[51] Int. Cl.[6] ..... A45B 3/00

[52] U.S. Cl. ..... 135/65; 135/910; 362/102

[58] Field of Search ..... 135/65, 66, 910, 135/911, 16; 362/102, 32

[56] References Cited

U.S. PATENT DOCUMENTS

| | | | |
|---|---|---|---|
| 1,427,138 | 8/1922 | Walicki et al. | 135/910 X |
| 1,509,157 | 9/1924 | Leano | 362/102 X |
| 1,595,023 | 8/1926 | Probe | 135/910 X |
| 2,478,325 | 8/1949 | Russell | 135/910 X |
| 3,275,815 | 9/1966 | Petroff et al. | 362/102 X |
| 4,062,371 | 12/1977 | Bolen | 135/66 |
| 4,093,969 | 6/1978 | Maynor, Jr. | 135/910 X |
| 4,625,742 | 12/1986 | Phillips | 135/66 |
| 4,872,468 | 10/1989 | Cole | 135/16 |
| 5,219,402 | 6/1993 | Kondo et al. | 362/102 X |

FOREIGN PATENT DOCUMENTS

| | | | |
|---|---|---|---|
| 3811037 | 10/1989 | Germany | 135/910 |

*Primary Examiner*—Lanna Mai

*Attorney, Agent, or Firm*—Morton J. Rosenberg; David I. Klein

[57] ABSTRACT

A multipurpose cane which includes a hollow handle, and a retractable walking-stick fixedly secured to the hollow handle fixe, wherein the hollow handle defines a storage chamber for keeping personal accessories, and holds a lamp and battery assembly controlled by a switch to produce light for illumination and/or warning.

3 Claims, 4 Drawing Sheets

MULTIPURPOSE CANE

BACKGROUND OF THE INVENTION

The present invention relates to walking-sticks, and relates more particularly to such a walking-stick which holds a lamp and battery assembly in the handle thereof and controlled by a switch to produce light for illumination and/or warning.

Regular canes for walking may be made retractable so as to fit different users of different heights. Because walking in the dark is dangerous, there is a strong demand for canes which are equipped with illuminator or warning signal means. Furthermore, an aged person may have to regularly take medicine or to carry certain medicine for emergency use. It is helpful to aged persons to provide a walking-stick having storage chamber for keeping medicine or personal accessories.

SUMMARY OF THE INVENTION

The present invention has been accomplished under the circumstances in view. It is one object of the present invention to provide a multipurpose cane which has a lamp and a warning light at two opposite ends of the handle thereof respectively controlled by a switch to give off light for illumination and to give a visual warning signal. It is another object of the present invention to provide a multipurpose cane which has a storage chamber defined in the handle thereof for keeping personal accessories. It is still another object of the present invention to provide a multipurpose cane in which the handle is integrally molded in a hollow structure, and the electrical parts (lamp bulb, warning light, switch, and battery case) are made in a module convenient for installation and repair. According to the preferred embodiment of the present invention, the multipurpose cane comprises a handle, a retractable cane body fixedly connected to the handle, and a lamp and battery assembly installed in the handle, wherein the handle comprises a horizontal chamber having a first open end and a second open end, a vertical partition wall disposed inside the horizontal chamber in the middle, a horizontal partition wall perpendicularly extending from the vertical partition wall, an end cap fastened to the first open end of the horizontal chamber, and a lamp lens fastened to the first open end of the horizontal chamber above the end cap and the horizontal partition wall; the lamp and battery assembly is installed inside the horizontal chamber at the second open end, comprising a battery case, which holds two battery cells, a circuit board mounted on one side of the battery case and connected to the battery cells, a flexible plastic face board coupled to the battery case and adapted to cover the second open end of the horizontal chamber, a switch mounted in a hole in the flexible plastic face board, a lamp bulb mounted in a hole in the flexible plastic face board and connected to the circuit board and controlled to operate by the switch, a backward extension plate extending from the battery case and disposed above the horizontal partition wall, a light emitting diode mounted on the backward extension plate and disposed behind the lamp lens and electrically connected to the circuit board by an electrical wire and controlled to operate by the switch.

DETAILED DESCRIPTION OF THE PREFERRED EMBODIMENT

Figure 1:
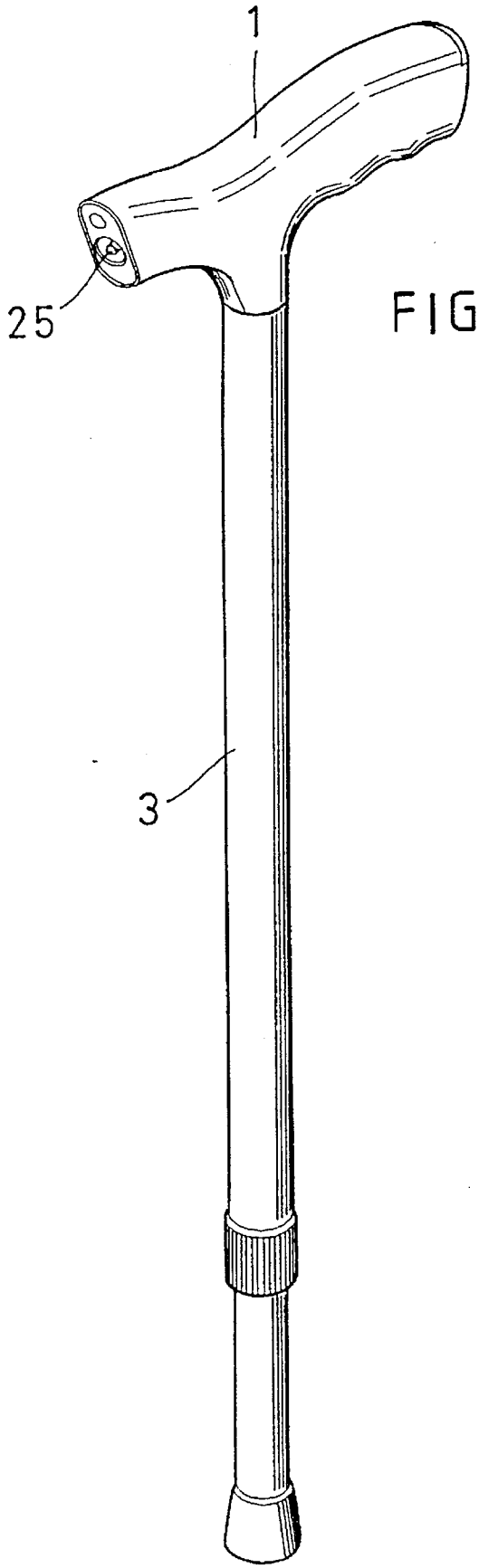
FIG. 1 is an elevational view of multipurpose cane according to the present invention.

Referring to FIG. 1, a multipurpose cane in accordance with the present invention comprises a handle 1, and a retractable stick 3 fixedly secured to the handle 1.

Figure 2:
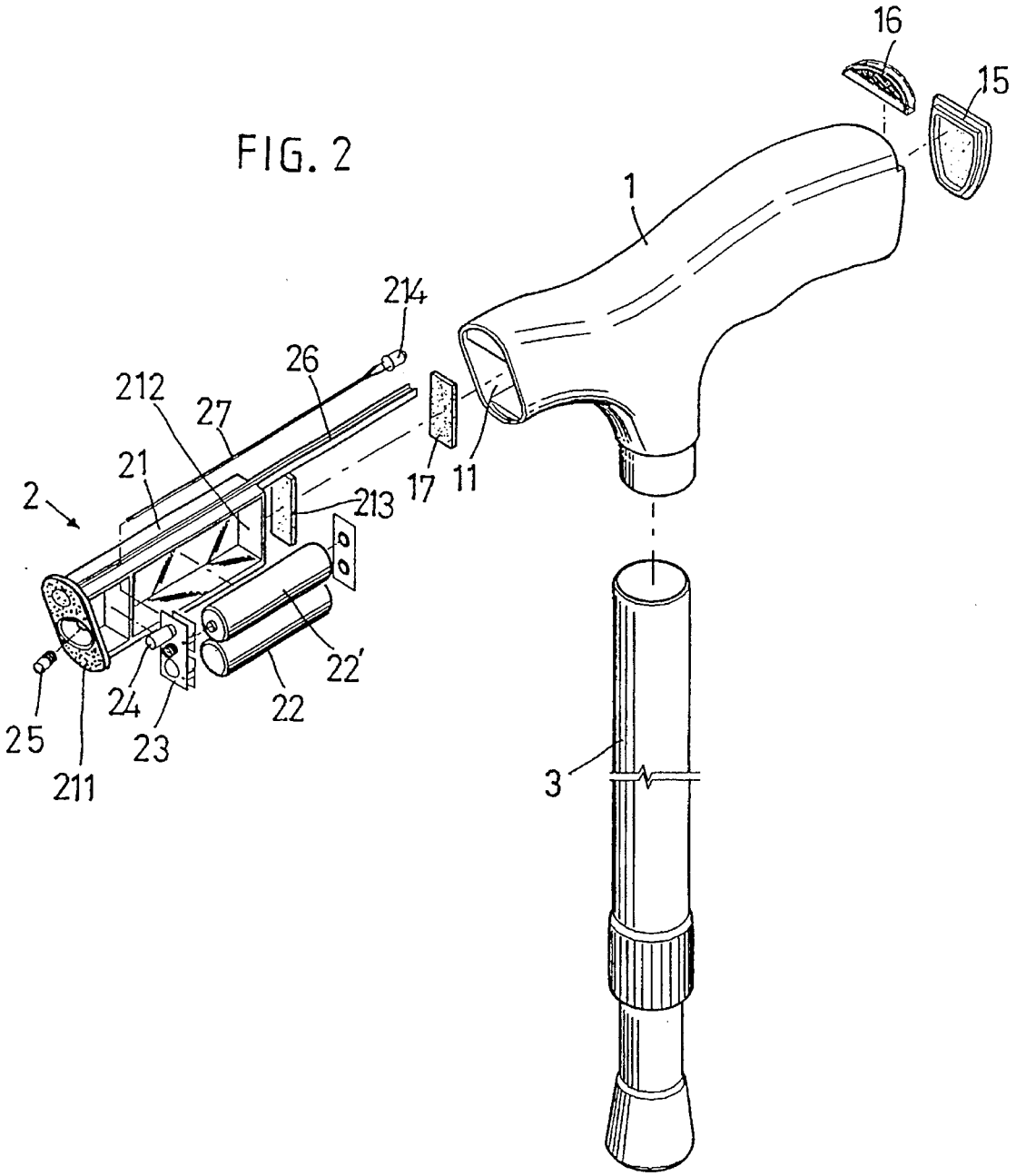
FIG. 2 is an exploded view of the multipurpose cane shown in FIG. 1.
Figure 3:
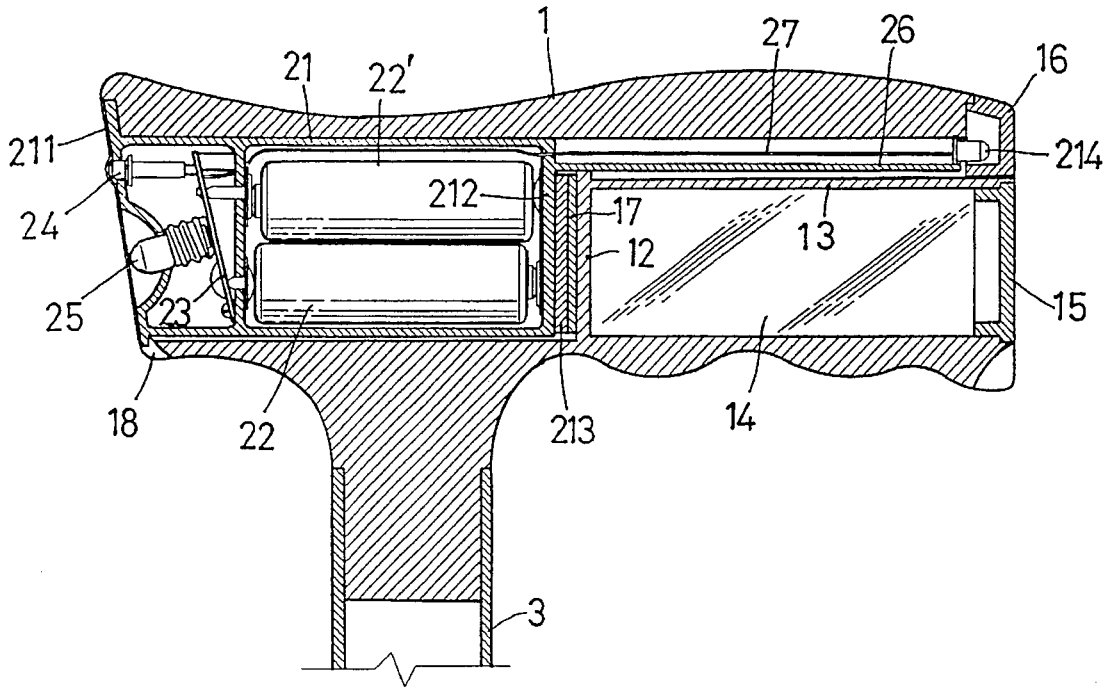
FIG. 3 is a sectional view of the handle of the multipurpose cane shown in FIG. 1, showing the lamp and battery assembly installed.

Referring to FIGS. 2 and 3, the handle 1 comprises a horizontal chamber 11, a vertical partition wall 12 disposed in the middle of the horizontal chamber 11, a horizontal partition wall 13 perpendicularly extending from the vertical partition wall 12 to one end of the handle 1 defining a storage chamber 14 for keeping personal accessories. An end cap 15 is fastened to the right end of the handle 1 to close the storage chamber 14. A lamp lens 16 is fixedly secured to the right end of the handle 1 above the end cap 15. A magnetic plate 17 is fastened to the left side of the vertical partition wall 12. A lamp and battery assembly 2 is installed in the horizontal chamber 11 at the left side (opposite to the storage chamber 14). The lamp and battery assembly 2 comprises a battery case 21, two #4 battery cells 22, 22' mounted in the battery case 21, a magnetic plate 213 fixedly fastened to the back side 212 of the battery case 21, a circuit board 23 fastened to the front side of the battery case 21, a switch 24, a lamp bulb 25 mounted on the circuit board 23 and connected to the battery cells 22, 22, a flexible plastic face board 211 coupled to the front side of the battery case 21, a backward extension plate 26 extending from the back side 212 of the battery case 21 and disposed above the horizontal partition wall 13 of the handle 1, a red LED (light emitting diode) 214 mounted on the backward extension plate 26 and disposed behind the lamp lens 16 and electrically connected to the circuit board 23 by an electrical wire 27. The flexible plastic face board 211 has holes (not shown) which receive the switch 24 and the lamp bulb 25 respectively. When the lamp and battery assembly 2 is installed, the magnetic plate 213 is connected to the magnetic plate 17, and the flexible plastic face board 211 is covered on the left end of the handle 1 to close the horizontal chamber 11.

Referring to FIG. 3 again, the handle 1 has an end notch 18 into which the finger can be inserted to remove the lamp and battery assembly 2 out of the handle 1. Because the red LED 214, the lamp bulb 25, and the switch 24 are disposed at the two opposite ends of the handle 1, they do not interfere with the holding of the hand.

Figure 4:
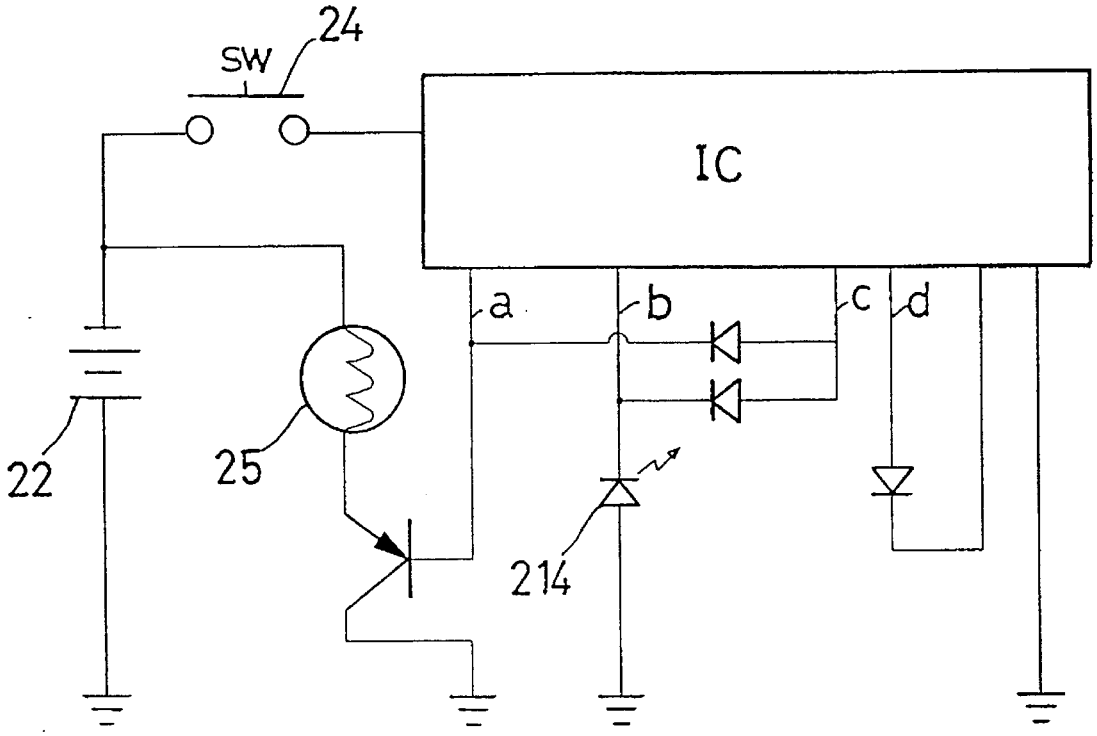
FIG. 4 is a circuit diagram of the lamp and battery assembly according to the present invention.

FIG. 4 shows the circuit diagram of the lamp and battery assembly 2. When in use, for example, when the switch 24 is pressed once, IC is triggered to send an electrical signal through circuit "a" to the lamp bulb 25, causing the lamp bulb 25 to be turned on; when the switch 24 is pressed twice, IC is triggered to send an electrical signal through circuit "b" to the red LED 214, causing the red LED 214 to flash; when the switch 24 is continuously pressed three times, IC is triggered to send an electrical signal through circuit "c" to the lamp bulb 25 and the red LED 214, causing the lamp bulb 25 to be turned on and the red LED 214 to flash; when the switch 24 is continuously pressed four times, IC is triggered to send an electrical signal through circuit "d" to the lamp bulb 25 and/or the red LED 214, causing the lamp bulb 25 and/or the red LED 214 to be turned off.

While only one embodiment of the present invention has been shown and described, it will be understood that various modifications and changes could be made without departing from the spirit and scope of the invention.

What the invention claimed is:

1. A multipurpose cane comprising a handle, a retractable cane body fixedly connected to said handle, and a lamp and battery assembly installed in said handle, wherein:

said handle comprises a horizontal chamber having a first open end and a second open end, a vertical partition wall disposed inside said horizontal chamber in the middle, a horizontal partition wall perpendicularly extending from said vertical partition wall, an end cap fastened to the first open end of said horizontal chamber, and a lamp lens fastened to the first open end of said horizontal chamber above said end cap and said horizontal partition wall;

said lamp and battery assembly is installed inside said horizontal chamber at said second open end, comprising a battery case, which holds two battery cells, a circuit board mounted on one side of said battery case and connected to said battery cells, a flexible plastic face board coupled to said battery case and to cover the second open end of said horizontal chamber, a switch mounted in a hole in said flexible plastic face board, a lamp bulb mounted in a hole in said flexible plastic face board and connected to said circuit board and controlled to operate by said switch, a backward extension plate extending from said battery case and disposed above said horizontal partition wall, a light emitting diode mounted on said backward extension plate and disposed behind said lamp lens and electrically connected to said circuit board by an electrical wire and controlled to operate by said switch.

2. The multipurpose cane of claim 1 wherein said handle further comprises a magnetic plate fixedly secured to said vertical partition wall; said lamp and battery assembly further comprises a magnetic plate fixedly secured to said battery case and adapted for connection to the magnetic plate of said handle by magnetic attraction.

3. The multipurpose cane of claim 1 wherein said horizontal partition wall and said vertical partition wall define a storage chamber inside said handle in communication with said first open end for keeping personal accessories.

* * * * *